United States Patent [19]

Neuls

[11] 4,067,067

[45] Jan. 10, 1978

[54] PRECIPITATION COVER

[75] Inventor: Frederick W. Neuls, Roanoke, Ind.

[73] Assignee: Industrial Engineering, Inc., Fort Wayne, Ind.

[21] Appl. No.: 645,194

[22] Filed: Dec. 29, 1975

[51] Int. Cl.[2] ..... A41D 9/00

[52] U.S. Cl. ..... 2/84

[58] Field of Search ..... 2/82, 84, 49 R, 87, 2/80, DIG. 7, 114, 88

[56] References Cited

U.S. PATENT DOCUMENTS

| | | | |
|---|---|---|---|
| 3,014,218 | 12/1961 | Smith | 2/87 |
| 3,042,931 | 7/1962 | Sawyer | 2/88 |
| 3,156,927 | 11/1964 | Grimm et al. | 2/114 |
| 3,946,443 | 3/1976 | Knight | 2/82 |

*Primary Examiner*—Werner H. Schroeder
*Assistant Examiner*—Doris L. Troutman

[57] ABSTRACT

A precipitation cover which can be easily and inexpensively manufactured comprising a thin, flexible, and elongated sheet of material having a plurality of longitudinal folds and devoid of conventional tailoring. The folds are joined at one end by a seam and are open at the opposite end. The combination of the seam and the folds provides an enclosure with a side opening centered between a plurality of pleats. The side opening of the enclosure may be partially closed by a fastening device. At the opposite side of the enclosure, the pleats have a common border. The pleats are movable from a folded position adjacent the enclosure to an unfolded position closing the side opening and surrounding a person within the enclosure, whereby a person within the enclosure and with the pleats unfolded can be, for all practical purposes, nearly completely sheltered from various forms of precipitation, particularly rain. In a specific embodiment, the precipitation cover of the invention can be manufactured in rolls with advertising imprinted thereon and perforations between each precipitation cover whereby they can be easily torn off and dispensed from the roll, as desired.

13 Claims, 5 Drawing Figures

PRECIPITATION COVER

BACKGROUND OF THE INVENTION

1. Field of the Invention

The present invention relates to precipitation covers, and in particular to covers which are lightweight, impervious to water, flexible, inexpensive, and disposable. While such covers may be used for every day protection, they are particularly useful where it is desired to provide an inexpensive, disposable means of protection to customers or patrons of a business establishment who have failed to carry rain gear, umbrellas, etc., and are victims of unexpected rain storms and the like.

2. Description of the Prior Art

Means for protection from rain, sleet, snow, etc, have heretofore been proposed in a number of embodiments. Clothing such as overcoats, ponchos, capes, and the like, plus various forms of umbrellas and other shielding devices have long been available to provide such protection. These items are typically made of flexible plastic sheet material or cloth which is either inherently water resistant or treated to function as such. In the case of clothing, all the items require at least some form of conventional tailoring. Consequently, such clothing is fairly expensive to manufacture, own and replace. Some of the clothing garmets only cover a person from the shoulders down, while others cover the head as well. In the case of umbrellas or the like, these devices typically provide only limited protection of the upper portion of the body. They also require periodic upkeep and or replacement at no slight cost to the owner. Often clothing and umbrellas or the like must be used together to achieve the best protection. Regardless, in all instances the protective garmet or device must be constantly carried by a person seeking continual protection from such unexpected weather.

Precipitation covers made of plastic materials, have been proposed both as reusable clothing and disposable items. Without proper care, precipitation covers made of plastic materials tend to wrinkle and become unsightly. Most are too expensive to be disposable.

It would therefore be desirable to have an inexpensive, disposable precipitation cover. It is also desirable that such a precipitation cover be capable of covering the head as well as the shoulders and lower portions of persons of all sizes. By requiring no conventional tailoring, the cover can be easily and inexpensively manufactured so as to be easily dispensed to partrons or customers of a business as a disposable precipitation cover in the event that such persons need protective garmets or the like, but have failed to bring such garmets or devices with them.

SUMMARY OF THE INVENTION

It is therefore an object of the invention to provide an improved precipitation cover.

It is another object of the invention to provide an inexpensive precipitation cover.

It is still another object of the invention to provide an improved disposable precipitation cover.

It is still another object of the invention to provide a light-weight precipitation cover which can be inexpensively manufactured so as to be disposable after one use.

It is further an object of the invention to provide an improved precipitation cover that provides protection for the head and body of a person therein.

It is still further an object of the invention to provide a precipitation cover requiring no conventional tailoring and having no conventional features such as collars, shoulders, sleeves, and the like.

It is still further an object of the invention to provide a precipitation cover capable of fitting persons of all sizes.

It is yet another object of the invention to provide a precipitation cover that can be manufactured in volume all connected together in the form of a continuous strip, and can be easily dispensable, as from the strip in the form of a roll or the like.

It is yet another object of the invention to provide a precipitation cover that is capable of bearing advertising or other printing and functioning as a promotional give-away.

In the broader aspects of this invention there is provided a precipitation cover comprising a thin flexible and elongated sheet of material having a plurality of longitudinal folds that are joined by a seam at one end and open at the opposite end. The seam and folds combine to form an envelope having a side opening centered between a plurality of pleats. These pleats are joined at the opposite side of the envelope and are movable from folded position adjacent the envelope to an unfolded position closing the side opening and surrounding a person within the envelope. A person within the enclosure and with the pleats unfolded can thereby be substantially protected from rain or other types of precipitation.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings wherein.

DESCRIPTION OF THE SPECIFIC EMBODIMENT

Figure 5:
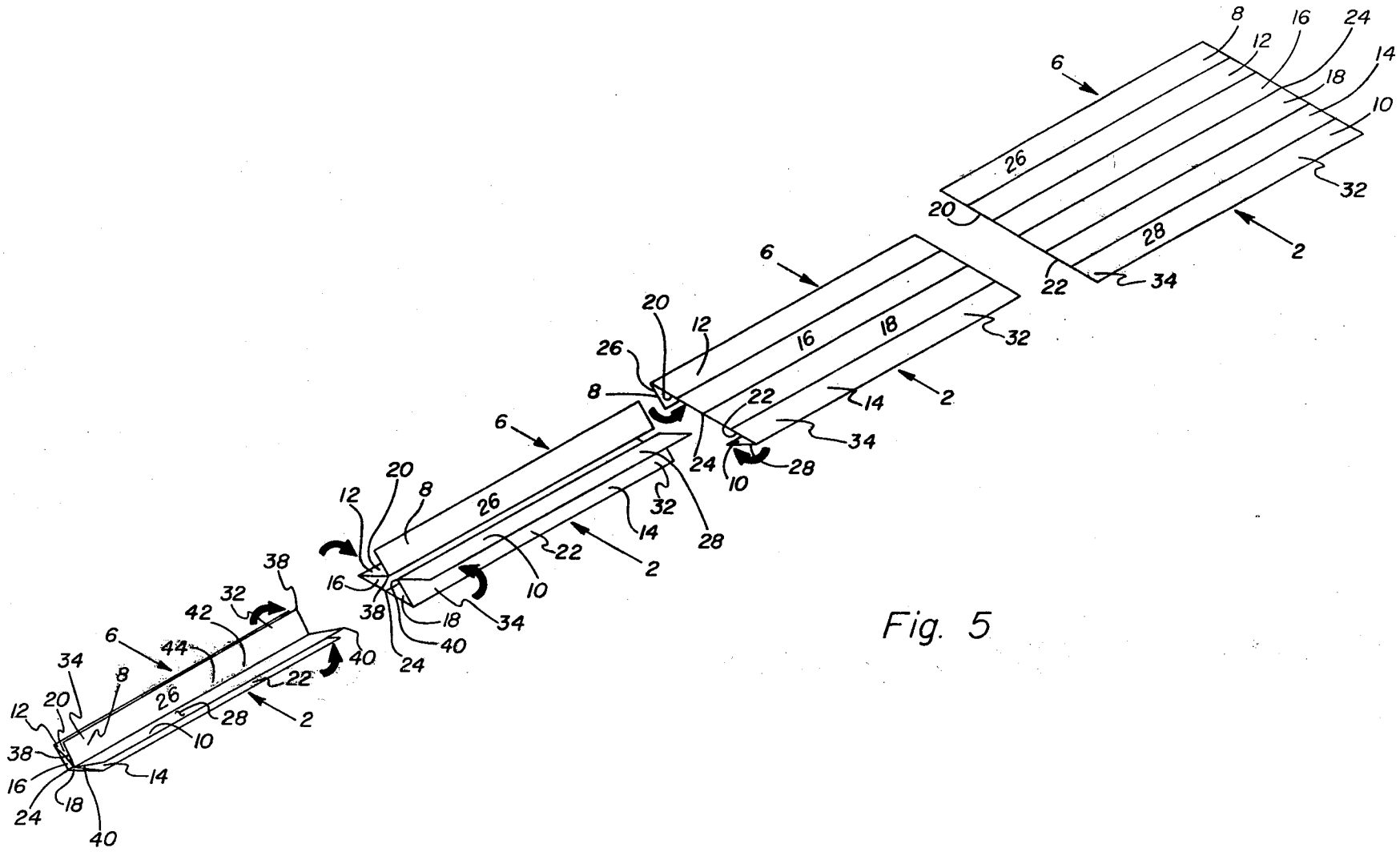
FIG. 5 is a perspective view of the folding technique used in the manufacture of the cover.

Referring to the drawings, the improved precipitation cover 2 of the invention and a roll 4 of the covers are shown. Precipitation cover 2 comprises a thin, flexible, and elongated sheet 6 of material, which in a specific embodiment may be made of plastic or any other material that is relatively impervious to water. Sheet 6 comprises six (6) longitudinal folds or panels 8, 10, 12, 14, 16, and 18 of equal width and length. The folding of sheet 6 may be accomplished by the sequence of steps as shown in FIG. 5.

Starting with sheet 6 in a horizontal plane, the two outer most panels 8 and 10 are folded downwardly to lie flat against the lower surfaces 20 and 22 of adjacent panels 12 and 14, respectively. Panels 12 and 14 are then folded upwardly toward the center 24 of sheet 6 until panels 12 and 14 overlay 16 and 18, respectively. Panels 16 and 18 are then folded along center 24 toward one another until the upper surfaces 26 and 28 of panels 8 and 10, respectively, meet one another.

Folds or panels 8, 10, 12, 14, 16, and 18 are held in a folded condition by seam 30 at the upper end 32 of cover 2. In a specific embodiment, sheet 6 is of a thermoplastic plastic material and seam 30 is a heat seal. Seam 30 provides extra reinforcement and rigidity at the upper end 32 of cover 2. The lower end 34 of folds 8, 10, 12, 14, 16, and 18 are not joined so as to leave a bottom opening 36. In combination, reinforced seam 30 and panels 8, 10, 12, 14, 16 and 18 form a pair of pleats 38 and 40 with an envelope 42 centered therebetween. More specifically, envelope 42 is formed by panels 8 and 10 and seam 30, thereby leaving a side opening 44 in addition to bottom opening 36. Pleats 38 and 40 have a common border at center 24 of sheet 6.

Figure 3:
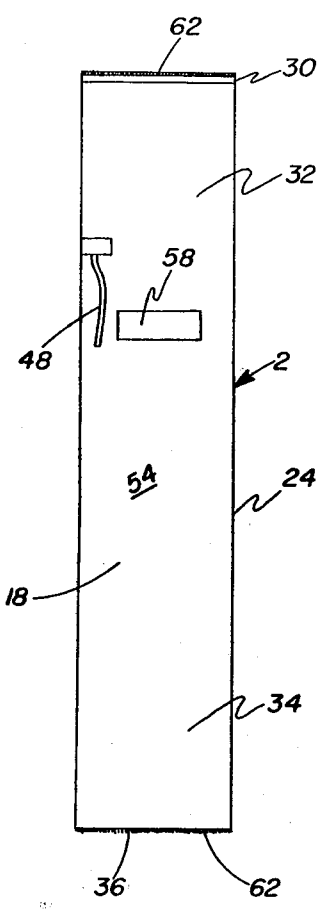
FIG. 3 is a fragmentary side view of the cover showing details of the means for closing the side opening of the cover.
Figure 2:
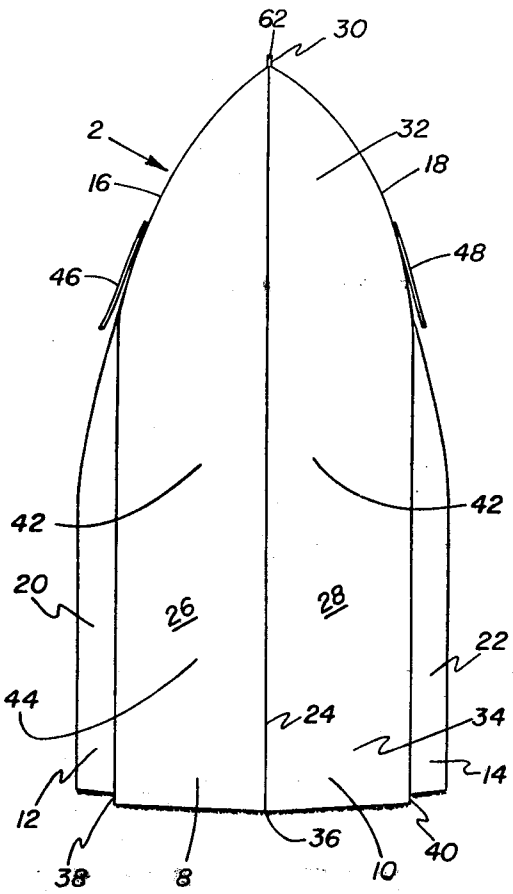
FIG. 2 is a front view of the cover in an open position.
Figure 1:
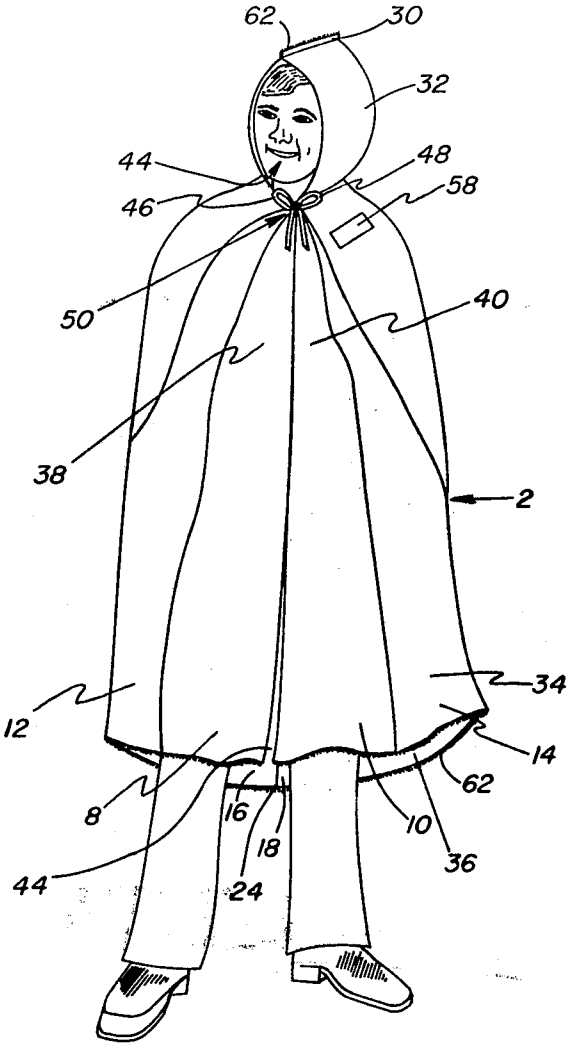
FIG. 1 is a perspective view of the precipitation cover of the invention as it is intended to be worn during use.

Fastening means 46 and 48 are suitably secured to pleats 38 and 40 respectively. In securing fastening means 46, 48 to pleats 38, 40, folds 10, 14 and 18 are secured together and folds 8, 12 and 16 are secured together. Fastening means 46 and 48 may be fastened together to substantially close opening 44 of envelope 42 as best seen in FIG. 1 as at point 50. In a specific embodiment, fastening means 46 and 48 are ties or strings, conventional snaps or velcro strips.

Pleats 38 and 40 overlay envelope 42 until cover 2 is put into use in practice, reinforced seam 30 may be positioned over the top of the head of a person wearing cover 2 with pleats 38 and 40 depending from seam 30 over the body of the person to enclose the person in envelope 42 in a tent like fashion. The person within envelope 42 may then unfold pleats 38 and 40 below the fastening means 46 and 48 by pulling on panels 8 and 10 so as to close side opening 44 and enshroud his entire body within the unfolded panels 8 through 18 of cover 2. Engaging fastening means 46 and 48 will hold pleats 38 and 40 together and substantially close side opening 44 of cover 2. By this means, a person within cover 2 is substantially sheltered from precipitation while still having relatively free use of his arms and hands. Coupling fasteners 46 and 48 also causes the upper end 32 of cover 2 to conform to the contour of the head, neck, and shoulders of a person within cover 2. The outer surfaces 52 and 54 of panels 16 and 18, respectively, will ordinarily bear advertising or printing as at 56 and 58.

As mentioned above, the cover is made of a thin, light-weight, flexible material, and the dimensions of the cover are chosen to enhance the usefulness of the invention. The length of the cover is chosen to provide suitable covering for the head and most of the body of persons of virtually all heights. The width of the folds has been chosen to provide a cover having a circumference that will wrap around persons of nearly all sizes and shapes. The fastening means are located at a distance beneath the top seam which will provide sufficient head room for a person within.

Figure 4:
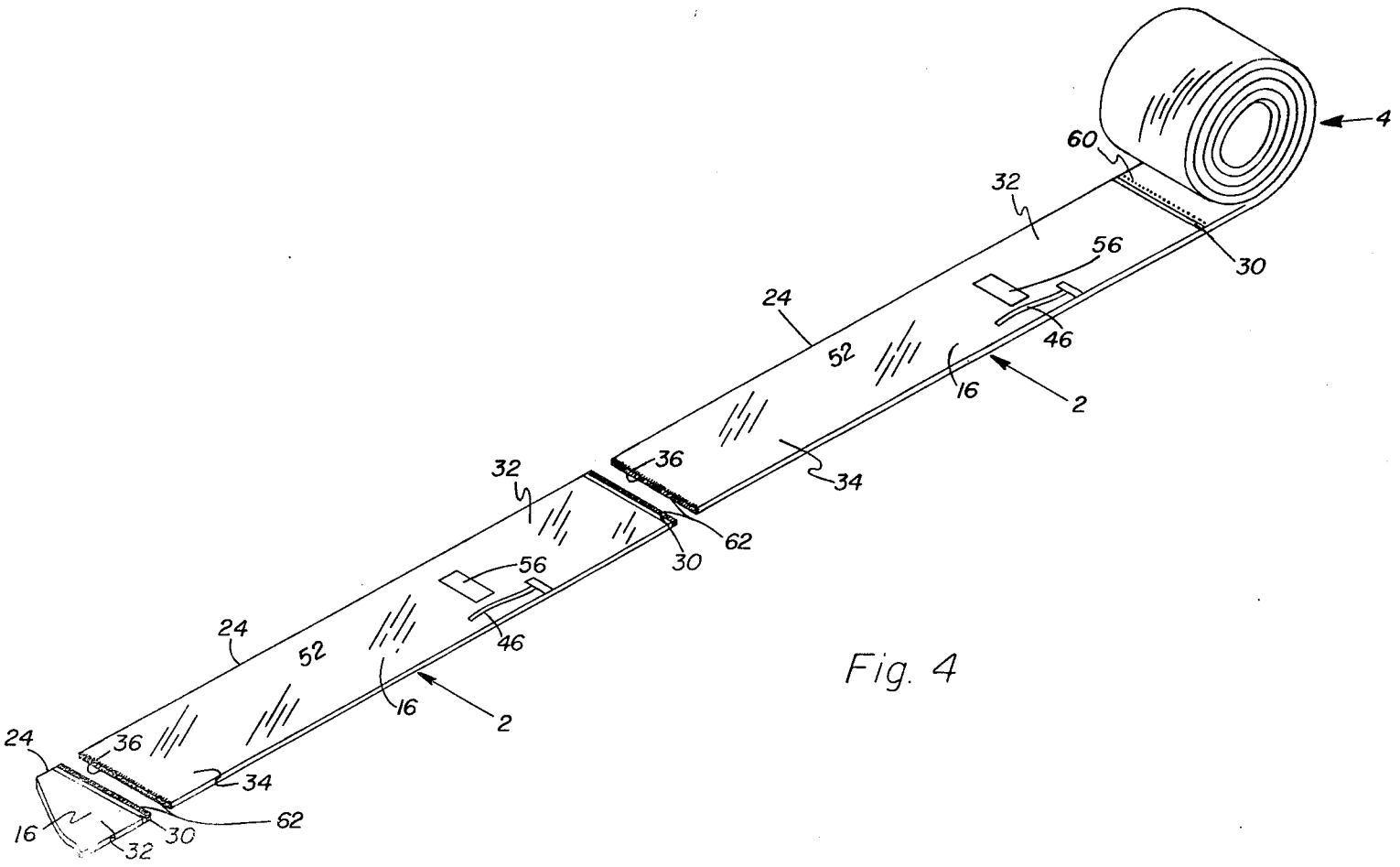
FIG. 4 is a perspective view of a roll of the covers showing details of the dispensing of the covers.

In a specific embodiment, the precipitation cover is made of a thin sheet of flexible plastic material such as dacron polyester sheet material. In the same specific embodiment, the precipitation cover has the following dimensions:

Thickness = 1.25 mils
Length (width of sheet 6) = 50 inches
Width of fold = 9 inches
Circumference (length of sheet 6) = 54 inches
Distance from seam 30 to fastening means 46, 48 = 10 inches The improved precipitation cover of the invention may be manufactured in volume in the form of a continuous strip as shown in FIG. 4. In a specific embodiment, the precipitation covers 2 may be dispensed therefrom by tearing covers 2 from the continuous roll 4 thereof, as best seen in FIG. 4. Along the width of each consecutive cover 2 and adjacent each consecutive seam 30 is a perforated strip 60 to facilitate severing one cover 2 from the next. This severing can be accomplished by simply grasping on cover 2 by its upper end 32 and the next cover 2 by its lower end 34 and pulling the covers 2 apart. This tearing will normally provide a clean edge as at 62, but it should be noted that even if the perforation does not produce a clean edge 62, the precipitation cover 2 is still completely usable since reinforced seam 30 remains unaffected.

The improved precipitation cover of the invention fills the need for an inexpensive and disposable precipitation cover which can be used to cover the head and shoulders and a majority part of the lower body, as needed. The precipitation cover can be manufactured relatively inexpensively such that it can be dispensed by restaurants, retail stores and the like to customers in the case of unexpected inclimate weather. While the precipitation cover of the invention can be manufactured so as to be reusable or disposable, it has particular usefulness as a disposable precipitation cover inasmuch as it is completely devoid of conventional tailoring; and thus, the cost can be such that a "single use" precipitation cover is practical. The precipitation cover can be manufactured in volume and dispensed from a roll as above described. The precipitation cover can also bear advertising or other printing in order to defray the cost thereof, if desired. While the precipitation cover of the invention incorporates all of these advantages over prior art precipitation covers such as raincoats, ponchos, capes, umbrellas and the like, the precipitation cover of the invention is still a desirable cover inasmuch as substantially all of one's body can be covered by the precipitation cover, if desired, and in a manner leaving the hands free for use.

While there have been described above the principles of this invention in connection with specific apparatus, it is to be clearly understood that this description is made only by way of example and not as a limitation to the scope of the invention.

I claim:

1. A precipitation cover comprising a thin, flexible and elongated sheet of material, said material being impervious to water, said sheet having a plurality of laterally extending folds, a reinforced seam holding said folds together at one end of said sheet, thereby defining two pleats of a plurality of layers of said material joined at said seam, said sheet having an opening at the opposite end of said sheet, said seam and said pleats thereby forming an envelope, said envelope having a side opening centered between said pleats, said pleats having a common border at the side opposite said side opening of said envelope, said pleats remote from said seam being movable from a first position in which said pleats are folded to a second position in which said pleats are unfolded to close said side opening, whereby a person within said envelope with said pleats unfolded to close said side opening is sheltered from rain or other precipitation.

2. The cover of claim 1 wherein said seam is adapted to rest upon the head of a person within said cover, said pleats and seam are adapted to overlay the top, back and sides of said head, the remainder of said cover is adapted to drape over said person's shoulders and lower body in a tent like manner.

3. The cover of claim 1 wherein said envelope includes means for closing said side opening of said envelope, said means being positioned between said seam and said opposite end opening of said envelope, said pleats between said seam and said closing means being held against unfolding by the same, said pleats between said closing means and said opposite end being unfoldable to close said side opening of said envelope and to enshroud nearly the entire body of said person within said envelope.

4. The cover of claim 3 wherein said cover is completely devoid of conventional tailoring having no openings for arms, hands, or head of said person within said cover.

5. The cover of claim 1 wherein said envelope includes means for closing said side opening of said envelope, said means being positioned between said seam and said opposite end opening of said envelope, whereby a person within said envelope and with said means operatively closing said side opening is sheltered from precipitation while having relatively free use of his arms and hands.

6. The cover of claim 1 wherein said closing means is secured to said pleats, respectively, adjacent opposite sides of said side opening, said closing means being securable to conform the upper portion of said cover to the contour of the head and neck of a person within said cover and the remaining portion of said cover to the contour of the shoulders and lower portion of the body of a said person within said cover.

7. The cover of claim 6 wherein said closing means is chosen from the group of fastening devices consisting of snaps, Velcro strips, and ties.

8. The cover of claim 1 wherein said folds have outer surfaces, said outer surfaces having printing thereon.

9. The cover of claim 1 wherein said laterally extending folds are about six in number.

10. The cover of claim 7 wherein said thin, flexible, and elongated sheet is of a thermoplastic sheet material and said seam is a heat seal.

11. The cover of claim 1 in combination with a plurality of identical covers, said covers being aligned is an end to end relationship with said one end of one of said covers adjacent to the other of said ends of another of said covers, said covers being joined together by a tear strip thereby forming an elongated strip of a plurality of covers individually separable by said tear strip.

12. The cover of claim 10 in combination with a plurality of identical covers, said covers being aligned in an end to end relationship with said one end of one of said covers adjacent to the other of said ends of another of said covers, said covers being joined together by tear strips thereby forming an elongated strip of a plurality of covers individually separable by said tear strips.

13. The strip of covers of claim 11 in the form of a roll, said tear strips being perforated strips of said sheet material.

* * * * *

UNITED STATES PATENT OFFICE

CERTIFICATE OF CORRECTION

Patent No. 4,067,067 Dated January 10, 1978

Inventor(s) Frederick W. Neuls

It is certified that error appears in the above-identified patent and that said Letters Patent are hereby corrected as shown below:

Column 4, Line 12 between "grasping" and "cover" change "on" to "one".

Column 6, Line 16 between "aligned" and "an" change "is" to "in".

Signed and Sealed this

*Eleventh* Day of *November 1980*

[SEAL]

*Attest:*

SIDNEY A. DIAMOND

*Attesting Officer*

*Commissioner of Patents and Trademarks*